US008651075B2

(12) United States Patent
Hayman et al.

(10) Patent No.: US 8,651,075 B2
(45) Date of Patent: Feb. 18, 2014

(54) ENGINE ASSEMBLY INCLUDING CAMSHAFT WITH INDEPENDENT CAM PHASING

(75) Inventors: Alan W. Hayman, Romeo, MI (US); Robert S. McAlpine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 484 days.

(21) Appl. No.: 12/962,942

(22) Filed: Dec. 8, 2010

(65) Prior Publication Data

US 2012/0145103 A1 Jun. 14, 2012

(51) Int. Cl.
*F01L 1/34* (2006.01)

(52) U.S. Cl.
USPC ..... 123/90.17; 123/90.15; 123/90.16; 123/90.55

(58) Field of Classification Search
USPC ..... 123/90.15, 90.16, 90.17, 90.31, 90.55
See application file for complete search history.

(56) References Cited

U.S. PATENT DOCUMENTS

| | | | | |
|---|---|---|---|---|
| 3,924,576 | A | 12/1975 | Siewert | |
| 4,506,633 | A | 3/1985 | Britsch | |
| 4,614,175 | A * | 9/1986 | Asayama | 123/704 |
| 4,727,849 | A * | 3/1988 | Nishida et al. | 123/704 |
| 4,790,286 | A * | 12/1988 | Nishida et al. | 123/704 |
| 5,217,229 | A | 6/1993 | Jaime | |
| 6,286,467 | B1 * | 9/2001 | Ancheta | 123/21 |
| 6,505,592 | B1 | 1/2003 | Hayman et al. | |
| 7,028,648 | B2 | 4/2006 | Hasegawa et al. | |
| 7,036,465 | B2 * | 5/2006 | Burk et al. | 123/21 |
| 7,055,470 | B2 * | 6/2006 | Kreuter et al. | 123/51 A |
| 7,464,675 | B1 * | 12/2008 | Schechter | 123/90.15 |
| 7,481,185 | B1 * | 1/2009 | Park et al. | 123/21 |
| 8,069,829 | B2 * | 12/2011 | Leone | 123/90.17 |
| 8,113,158 | B2 * | 2/2012 | Lancefield et al. | 123/90.17 |
| 8,118,000 | B2 * | 2/2012 | Surnilla | 123/21 |
| 8,132,546 | B2 * | 3/2012 | Surnilla | 123/21 |
| 8,196,563 | B2 * | 6/2012 | Javaherian et al. | 123/406.23 |
| 8,303,465 | B2 * | 11/2012 | Mukkala et al. | 477/33 |
| 8,347,849 | B2 * | 1/2013 | Wermuth et al. | 123/295 |
| 8,371,257 | B2 * | 2/2013 | Moon et al. | 123/90.17 |
| 2006/0112940 | A1 | 6/2006 | Roberts et al. | |
| 2008/0201059 | A1 | 8/2008 | Bryant | |
| 2009/0241871 | A1 * | 10/2009 | Hibino et al. | 123/90.6 |
| 2009/0308070 | A1 | 12/2009 | Alger, II et al. | |
| 2010/0126443 | A1 * | 5/2010 | Schneider | 123/90.15 |
| 2012/0042649 | A1 | 2/2012 | Kaneko et al. | |
| 2012/0048244 | A1 | 3/2012 | Hayman et al. | |

OTHER PUBLICATIONS

Hundleby, G.E., "Development of a Poppet-Valved Two-Stroke Engine—The Flagship Concept", Ricardo Consulting Engineers Ltd., SAE International Paper No. 900802, Feb. 1, 1990, 6 pgs.

* cited by examiner

*Primary Examiner* — Thomas Denion
*Assistant Examiner* — Thomas Olszewski
(74) *Attorney, Agent, or Firm* — Harness, Dickey & Pierce, P.L.C.

(57) ABSTRACT

An engine assembly may define first and second combustion chamber and may include a camshaft having a first lobe region engaged with the first valve arrangement and a second lobe region engaged with the second valve arrangement and rotatable relative to the first lobe region. The cam phaser may be coupled to the camshaft and may include a first member and a second member rotatable relative to the first member. The first lobe region may be fixed for rotation with the first member and the second lobe region may be fixed for rotation with the second member to vary valve timing for the second combustion chamber independently from the valve timing of the first combustion chamber.

20 Claims, 5 Drawing Sheets

ENGINE ASSEMBLY INCLUDING CAMSHAFT WITH INDEPENDENT CAM PHASING

FIELD

The present disclosure relates to engine assemblies including independent cam phasing among combustion chambers.

BACKGROUND

This section provides background information related to the present disclosure which is not necessarily prior art.

Internal combustion engines may combust a mixture of air and fuel in cylinders and thereby produce drive torque. Intake ports direct air flow to the combustion chamber. Combustion of the air-fuel mixture produces exhaust gases. Exhaust ports transport exhaust gases from the combustion chamber. Cam phasing may be used to vary intake and exhaust port opening.

SUMMARY

An engine assembly may include an engine structure, a first valve arrangement, a second valve arrangement, a camshaft, and a cam phaser. The engine structure may define a first combustion chamber and a second combustion chamber. The first valve arrangement may be supported on the engine structure and may control port opening for the first combustion chamber. The second valve arrangement may be supported on the engine structure and may control port opening for the second combustion chamber.

The camshaft may include a first lobe region engaged with the first valve arrangement and a second lobe region engaged with the second valve arrangement and rotatable relative to the first lobe region. The cam phaser may be coupled to the camshaft and may include a first member and a second member rotatable relative to the first member. The first lobe region may be fixed for rotation with the first member and the second lobe region may be fixed for rotation with the second member to vary valve timing for the second combustion chamber independently from the valve timing of the first combustion chamber.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Figure 2:
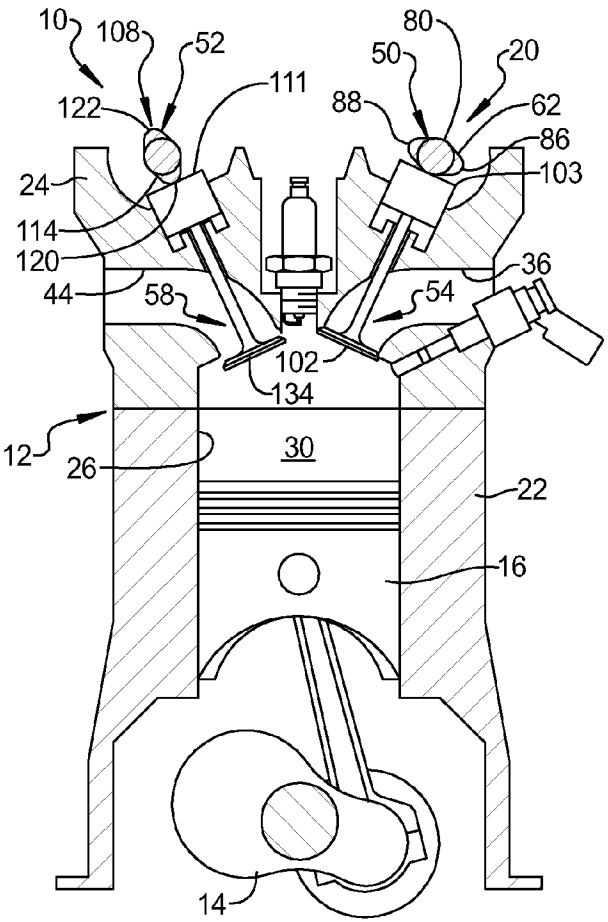
FIG. 2 is an additional section view of the engine assembly of FIG. 1.
Figure 1:
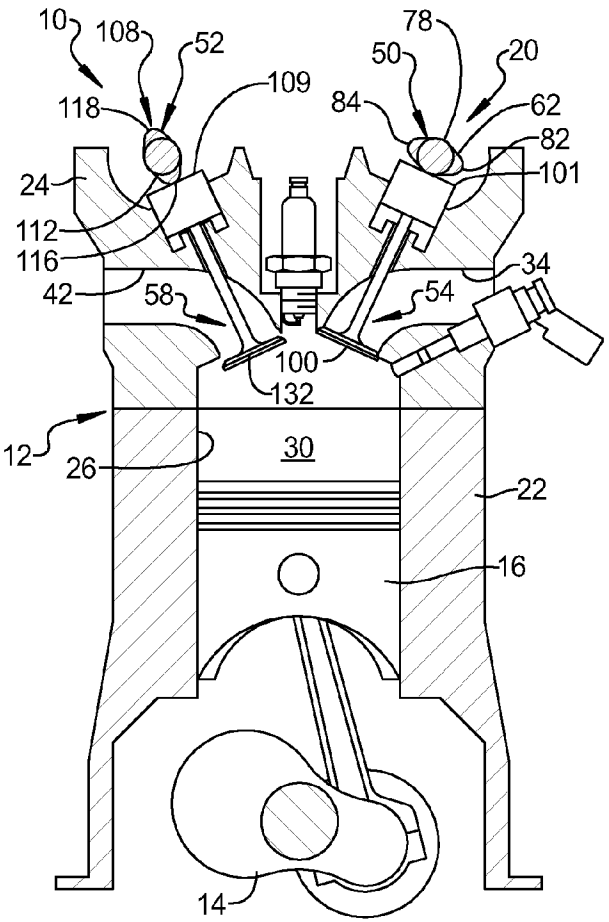
FIG. 1 is a section view of an engine assembly according to the present disclosure.
Figure 4:
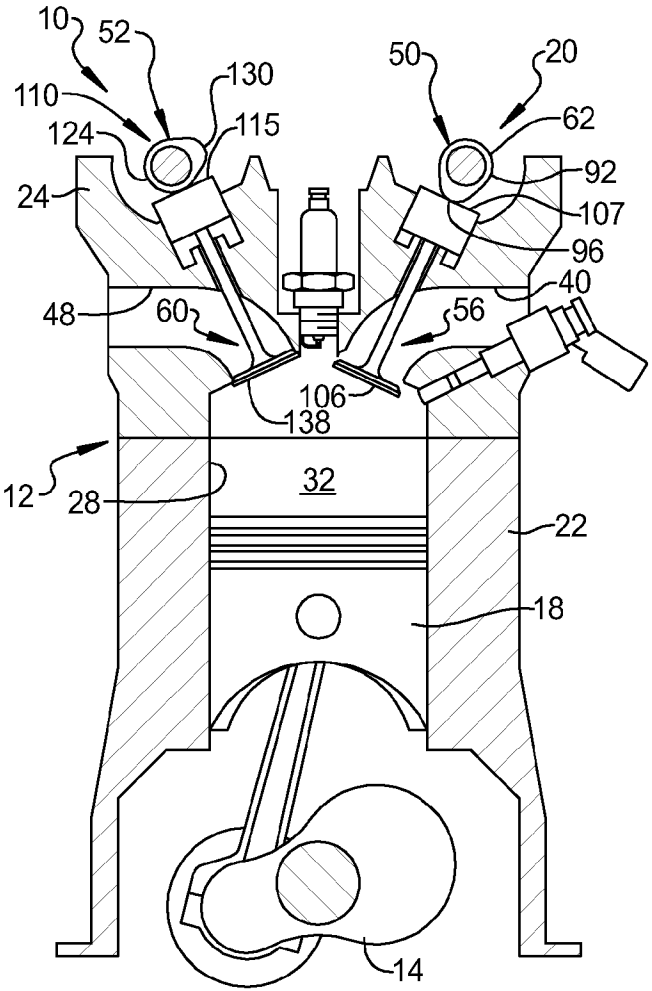
FIG. 4 is an additional section view of the engine assembly of FIG. 1.
Figure 3:
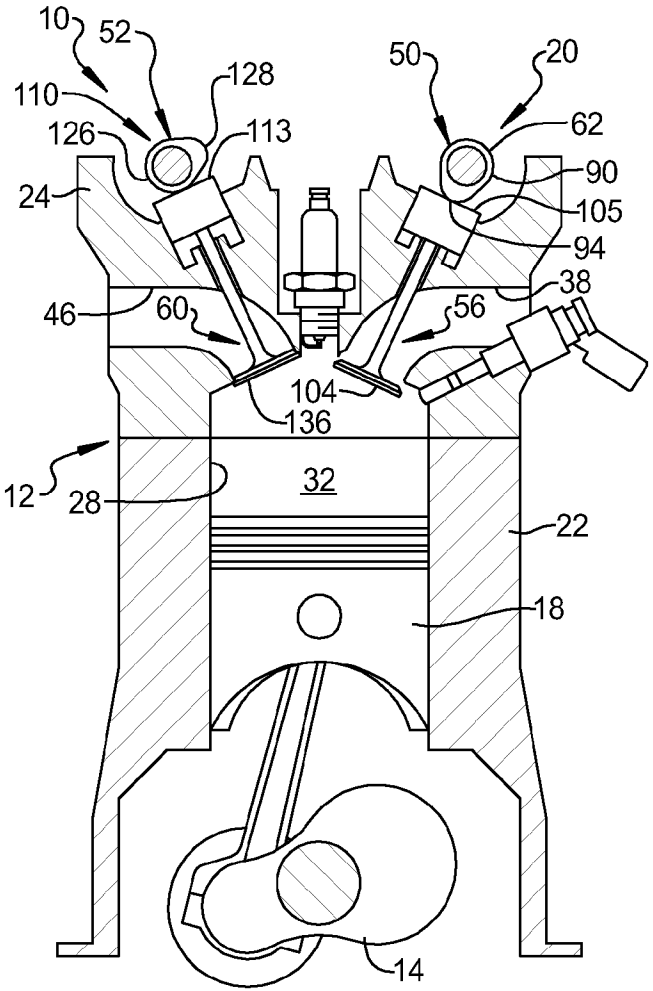
FIG. 3 is an additional section view of the engine assembly of FIG. 1.

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

An engine assembly 10 is illustrated in FIGS. 1-4 and may include an engine structure 12, a crankshaft 14, first and second pistons 16, 18, and a valvetrain assembly 20. The engine structure 12 may include an engine block 22 and a cylinder head 24. The engine structure 12 may define first and second cylinder bores 26, 28. Two cylinders of a four-cylinder arrangement are illustrated for simplicity. However, it is understood that the present teachings apply to any number of piston-cylinder arrangements and a variety of reciprocating engine configurations including, but not limited to, V-engines, inline engines, and horizontally opposed engines, as well as both overhead cam (both single and dual overhead cam) and cam-in-block configurations.

The first piston 16 may be located in the first cylinder bore 26 and the second piston 18 may be located in the second cylinder bore 28. The cylinder head 24 cooperates with the first cylinder bore 26 and the first piston 16 to define a first combustion chamber 30 and cooperates with the second cylinder bore 28 and the second piston 18 to define a second combustion chamber 32. The engine structure 12 may define, first, second, third and fourth intake ports 34, 36, 38, 40 and first, second, third and fourth exhaust ports 42, 44, 46, 48 in the cylinder head 24. The first intake port 34, the second intake port 36, the first exhaust port 42 and the second exhaust port 44 may be in communication with the first combustion chamber 30. The third intake port 38, the fourth intake port 40, the third exhaust port 46 and the fourth exhaust port 48 may be in communication with the second combustion chamber 32.

The valvetrain assembly 20 may include a first camshaft assembly 50, a second camshaft assembly 52, a first valve arrangement 54 controlling intake port opening for the first combustion chamber 30, a second valve arrangement 56 controlling intake port opening for the second combustion chamber 32, a first valve arrangement 58 controlling exhaust port opening for the first combustion chamber 30 and a second valve arrangement 60 controlling exhaust port opening for the second combustion chamber 32.

Figure 5:
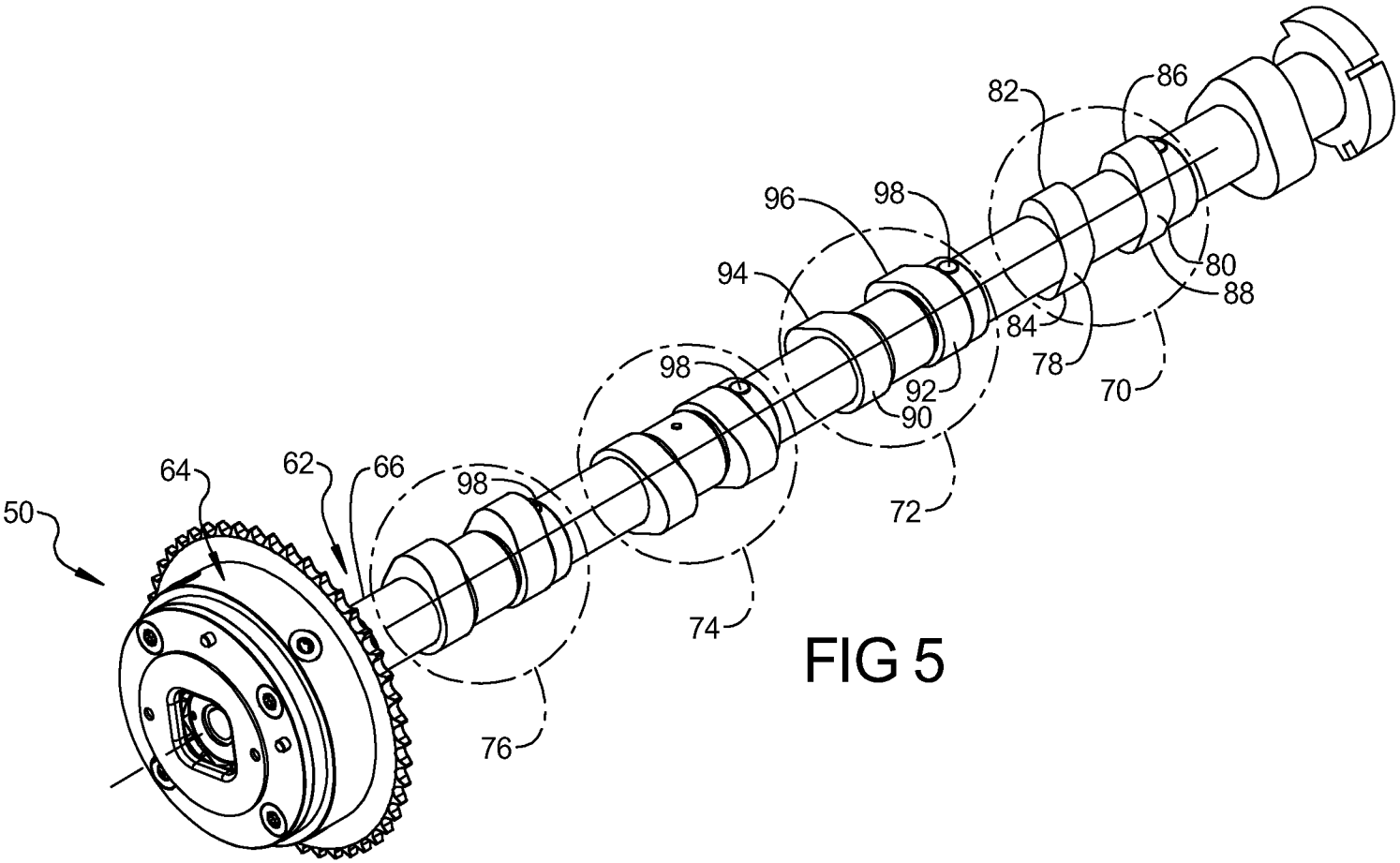
FIG. 5 is a perspective view of a camshaft assembly shown in FIGS. 1-4.
Figure 6:
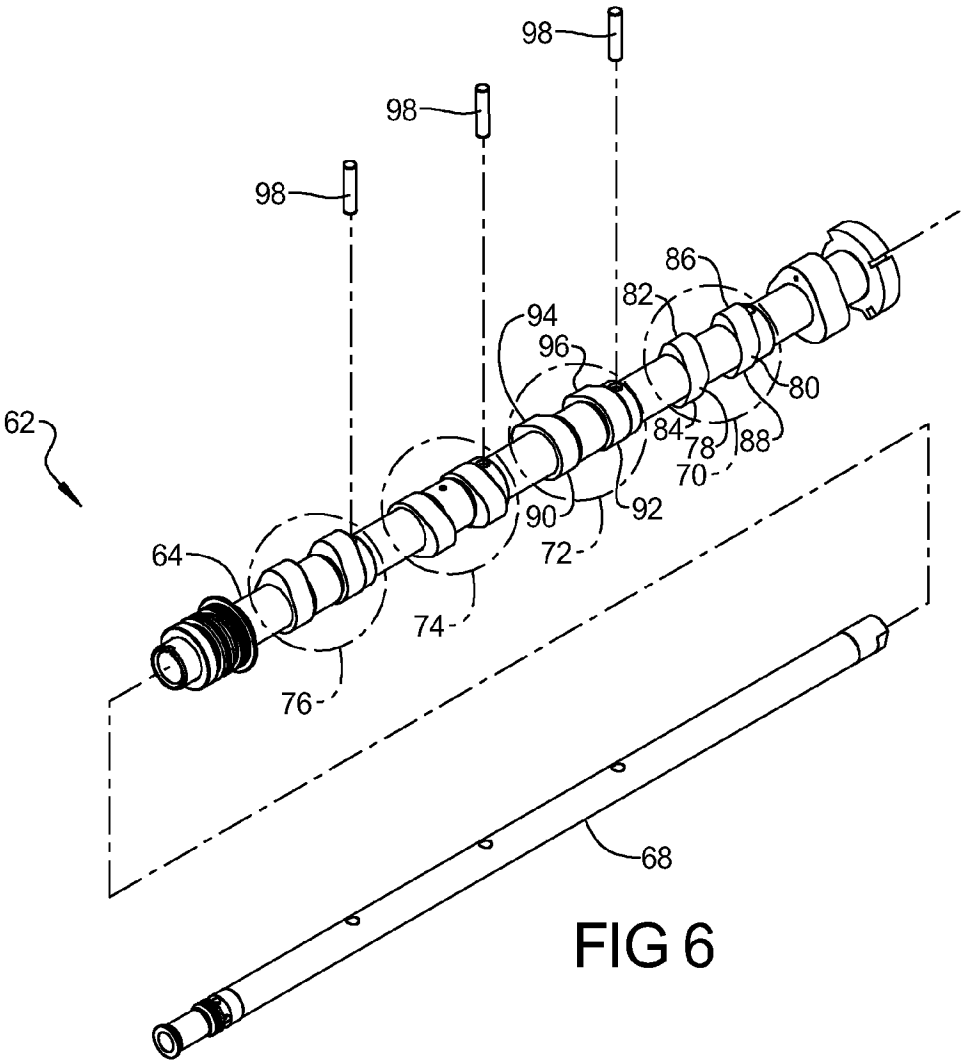
FIG. 6 is an exploded perspective view of the camshaft assembly of FIG. 5.

The first and second camshaft assemblies 50, 52 may be similar to one another. Therefore, for simplicity, the first camshaft assembly 50 will be described with the understanding that the description applies equally to the second camshaft assembly 52. The first camshaft assembly 50 may include a camshaft 62 and a cam phaser 64 (FIGS. 5, 7 and 8) coupled to the camshaft 62. With additional reference to FIGS. 5 and 6, the camshaft 62 may include a first shaft 66, a second shaft 68, a first lobe region 70, a second lobe region 72, a third lobe region 74 and a fourth lobe region 76.

The second shaft 68 may be supported for rotation within the first shaft 66. The first lobe region 70 may be located on and fixed for rotation with the first shaft 66 and the second lobe region 72, the third lobe region 74 and the fourth lobe region 76 may each be located on the first shaft 66 and fixed for rotation with the second shaft 68. The first lobe region 70 may be associated with the first combustion chamber 30 and the second lobe region 72 may be rotatable relative to the first lobe region 70 and associated with the second combustion chamber 32.

The first lobe region 70 may include first and second cam lobes 78, 80 rotationally fixed relative to one another. The first cam lobe 78 may form a first intake lobe and the second cam lobe 80 may form a second intake lobe. In the present non-limiting example, the first cam lobe 78 includes a first double lobe defining first and second peaks 82, 84 and the second cam lobe 80 includes a second double lobe defining third and fourth peaks 86, 88.

The second, third and fourth lobe regions 72, 74, 76 may be similar to one another. Therefore, for simplicity, the second lobe region 72 will be described with the understanding that the description applies equally to the third and fourth lobe regions 74, 76. The second lobe region 72 may include third and fourth cam lobes 90, 92 rotationally fixed relative to one another. The third cam lobe 90 may form a third intake lobe and the fourth cam lobe 92 may form a fourth intake lobe rotationally fixed relative to the third intake lobe. In the present non-limiting example, the third cam lobe 90 includes a first single lobe defining a single peak 94 and the fourth cam lobe 80 includes a second single lobe defining a single peak 96. The second, third and fourth lobe regions 72, 74, 76 may be fixed to the second shaft 68 by pins 98.

The first valve arrangement 54 may include a first intake valve 100 located in the first intake port 34 and engaged with the first cam lobe 78 via a valve lift mechanism 101 and a second intake valve 102 located in the second intake port 36 and engaged with the second cam lobe 80 via a valve lift mechanism 103. The second valve arrangement 56 may include a third intake valve 104 located in the third intake port 38 and engaged with the third cam lobe 90 via a valve lift mechanism 105 and a fourth intake valve 106 located in the fourth intake port 40 and engaged with the fourth cam lobe 92 via a valve lift mechanism 107.

The second camshaft assembly 52 may similarly define first and second lobe regions 108, 110. The first lobe region 108 may be associated with the first combustion chamber 30 and the second lobe region 110 may be rotatable relative to the first lobe region 108 and associated with the second combustion chamber 32. The first lobe region 108 may include first and second cam lobes 112, 114 rotationally fixed relative to one another. The first cam lobe 112 may form a first exhaust lobe and the second cam lobe 114 may form a second exhaust lobe. In the present non-limiting example, the first cam lobe 112 includes a first double lobe defining first and second peaks 116, 118 and the second cam lobe 114 includes a second double lobe defining third and fourth peaks 120, 122.

The second lobe region 110 may include third and fourth cam lobes 124, 126 rotationally fixed relative to one another. The third cam lobe 124 may form a third exhaust lobe and the fourth cam lobe 126 may form a fourth exhaust lobe rotationally fixed relative to the third exhaust lobe. In the present non-limiting example, the third cam lobe 124 includes a first single lobe defining a single peak 128 and the fourth cam lobe 126 includes a second single lobe defining a single peak 130.

The first valve arrangement 58 may include a first exhaust valve 132 located in the first exhaust port 42 and engaged with the first cam lobe 112 via a valve lift mechanism 109 and a second exhaust valve 134 located in the second exhaust port 44 and engaged with the second cam lobe 114 via a valve lift mechanism 111. The second valve arrangement 60 may include a third exhaust valve 136 located in the third exhaust port 46 and engaged with the third cam lobe 124 via a valve lift mechanism 113 and a fourth exhaust valve 138 located in the fourth exhaust port 48 and engaged with the fourth cam lobe 126 via a valve lift mechanism 115.

Figure 8:
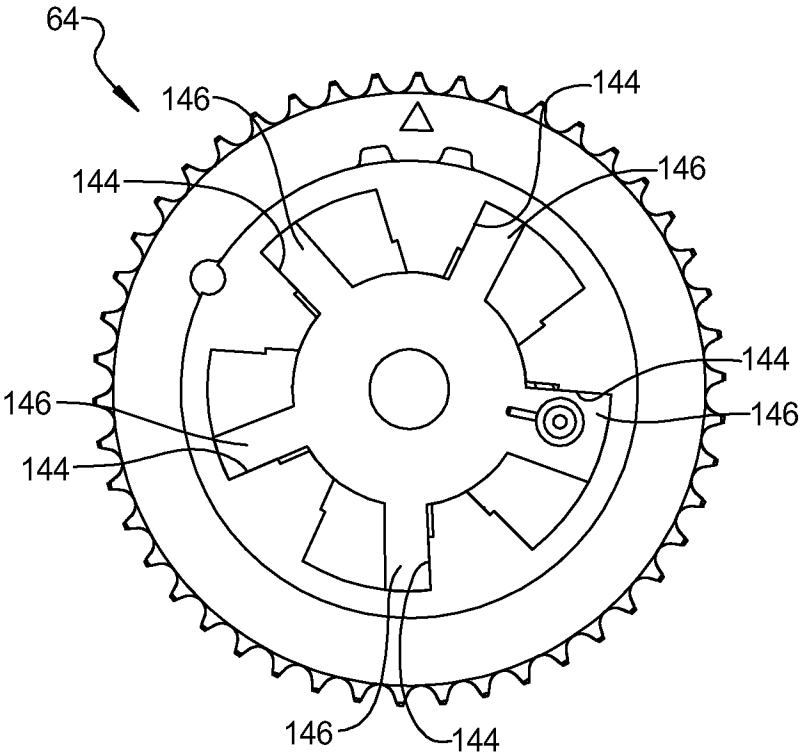
FIG. 8 is an additional schematic illustration of the cam phaser shown in FIG. 7.
Figure 7:
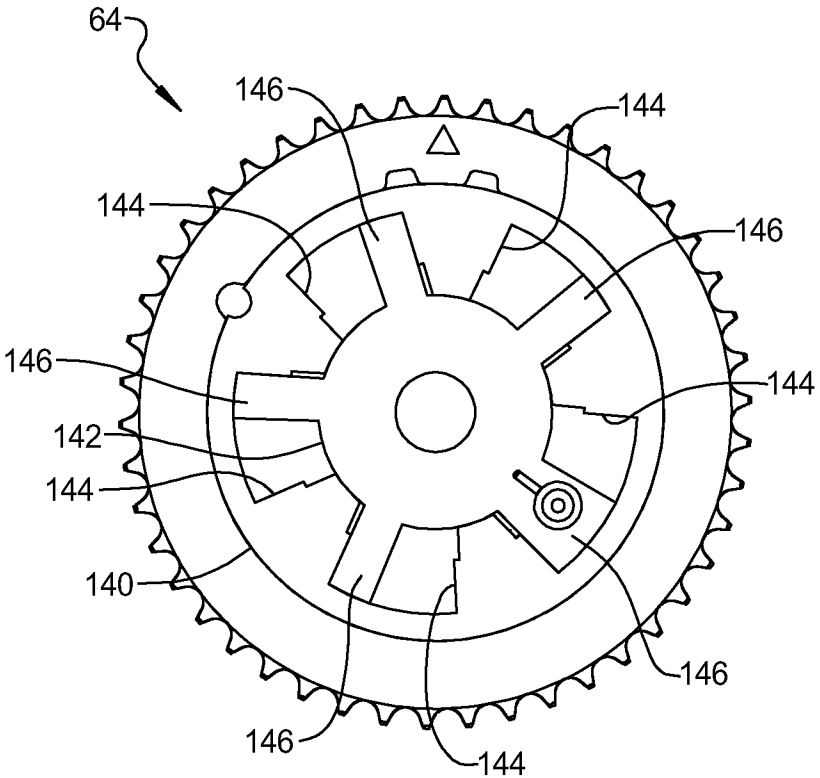
FIG. 7 is a schematic illustration of a cam phaser shown in FIG. 5.

With reference to FIGS. 7 and 8, the cam phaser 64 may include a first member 140 and a second member 142 rotatable relative to the first member 140 from a first position (FIG. 7) to a second position (FIG. 8). It is also understood that the present disclosure applies equally to arrangements where the first member 140 may also be rotatable relative to the crankshaft 14.

The first lobe region 70 may be fixed for rotation with the first member 140 and the second lobe region 72 may be fixed for rotation with the second member 142 to vary valve timing for the second combustion chamber 32 independently from the valve timing of the first combustion chamber 30. The first member 140 may form a stator and the second member 142 may form a rotor. The first shaft 66 may be fixed for rotation with the first member 140 and the second shaft 68 may be fixed for rotation with the second member 142.

In the present non-limiting example, the first and second members 140, 142 may define a series of fluid chambers 144 and the second member 142 may include vanes 146 exposed to fluid within the chambers 144. Hydraulic fluid, such as oil, supplied to the chambers 144 may displace the second member 142 relative to the first member 140.

The second camshaft assembly 52 may include a cam phaser (not shown) similar to the cam phaser 64 described above. Therefore, the second lobe regions 72, 110 may be phased independently from the first lobe regions 70, 108. The independent phasing may provide greater control for different operation related to the first and second combustion chambers 30, 32.

In the present non-limiting example, the first combustion chamber 30 may form a two-stroke operating cycle combustion chamber having one combustion event per crankshaft revolution. The second combustion chamber 32 may form a four-stroke operating cycle combustion chamber having one combustion event per two crankshaft revolutions. The exhaust gas from the first combustion chamber 30 may be provided to the second combustion chamber 32 for a subsequent combustion event.

The present disclosure applies to a variety of arrangements for phasing cylinders independently from one another. In a first non-limiting arrangement, an inline four cylinder engine may include the end cylinders being phased relative to the middle cylinders. In a second non-limiting example, a three-cylinder arrangement may include the end cylinders being phased relative to the middle cylinder.

What is claimed is:

1. A camshaft assembly comprising:

a camshaft including a first lobe region associated with a first combustion chamber and a second lobe region rotatable relative to the first lobe region and associated with a second combustion chamber; and a cam phaser coupled to the camshaft and including a first member and a second member rotatable relative to the first member, the first lobe region fixed for rotation with the first member and the second lobe region fixed for rotation with the second member to vary valve timing for the second combustion chamber independently from the valve timing of the first combustion chamber.

2. The camshaft assembly of claim 1, wherein the first lobe region includes first and second cam lobes rotationally fixed relative to one another.

3. The camshaft assembly of claim 2, wherein the second lobe region includes third and fourth cam lobes rotationally fixed relative to one another.

4. The camshaft assembly of claim 3, wherein the first member of the cam phaser includes a stator and the second member of the cam phaser includes a rotor disposed within the stator.

5. The camshaft assembly of claim 2, wherein the first cam lobe forms a first intake lobe and the second cam lobe forms a second intake lobe.

6. The camshaft assembly of claim 5, wherein the second lobe region includes a third intake lobe and a fourth intake lobe rotationally fixed relative to the third intake lobe.

7. The camshaft assembly of claim 2, wherein the first cam lobe forms a first exhaust lobe and the second cam lobe forms a second exhaust lobe.

8. The camshaft assembly of claim 7, wherein the second lobe region includes a third exhaust lobe and a fourth exhaust lobe rotationally fixed relative to the third exhaust lobe.

9. The camshaft assembly of claim 1, wherein the first lobe region includes a first double lobe defining first and second peaks and the second lobe region includes a first single lobe defining a single peak.

10. An engine assembly comprising:

an engine structure defining a first combustion chamber and a second combustion chamber;

a first valve arrangement supported on the engine structure and controlling port opening for the first combustion chamber;

a second valve arrangement supported on the engine structure and controlling port opening for the second combustion chamber;

a camshaft including a first lobe region engaged with the first valve arrangement and a second lobe region engaged with the second valve arrangement and rotatable relative to the first lobe region; and a cam phaser coupled to the camshaft and including a first member and a second member rotatable relative to the first member, the first lobe region fixed for rotation with the first member and the second lobe region fixed for rotation with the second member to vary valve timing for the second combustion chamber independently from the valve timing of the first combustion chamber.

11. The engine assembly of claim 10, wherein the first lobe region includes first and second cam lobes rotationally fixed relative to one another.

12. The engine assembly of claim 11, wherein the second lobe region includes third and fourth cam lobes rotationally fixed relative to one another.

13. The engine assembly of claim 12, wherein the first member of the cam phaser includes a stator and the second member of the cam phaser includes a rotor disposed within the stator.

14. The engine assembly of claim 11, wherein the first valve arrangement includes a first intake valve engaged with the first cam lobe and a second intake valve engaged with the second cam lobe.

15. The engine assembly of claim 14, wherein the second lobe region includes third and fourth cam lobes rotationally fixed relative to one another and the second valve arrangement includes a third intake valve engaged with the third cam lobe and a fourth intake valve engaged with the fourth cam lobe.

16. The engine assembly of claim 11, wherein the first valve arrangement includes a first exhaust valve engaged with the first cam lobe and a second exhaust valve engaged with the second cam lobe.

17. The engine assembly of claim 16, wherein the second lobe region includes third and fourth cam lobes rotationally fixed relative to one another and the second valve arrangement includes a third exhaust valve engaged with the third cam lobe and a fourth exhaust valve engaged with the fourth cam lobe.

18. The engine assembly of claim 10, wherein the first combustion chamber defines a two-stroke operating cycle combustion chamber and the second combustion chamber defines a four-stroke operating cycle combustion chamber.

19. The engine assembly of claim 10, wherein the engine structure defines an exhaust port in communication with the first combustion chamber and the second combustion chamber that transports exhaust gas from the first combustion chamber to the second combustion chamber.

20. The engine assembly of claim 10, wherein the first lobe region includes a first double lobe defining first and second peaks and the second lobe region includes a single lobe defining a single peak.

* * * * *